US007656167B1

(12) United States Patent
McLean

(10) Patent No.: US 7,656,167 B1
(45) Date of Patent: Feb. 2, 2010

(54) ELECTRIC FIELD GENERATOR INCORPORATING A SLOW-WAVE STRUCTURE

(75) Inventor: James S. McLean, Austin, TX (US)

(73) Assignee: TDK Corporation, Chiba (JP)

( * ) Notice: Subject to any disclaimer, the term of this patent is extended or adjusted under 35 U.S.C. 154(b) by 784 days.

(21) Appl. No.: 11/274,652

(22) Filed: Nov. 15, 2005

(51) Int. Cl.
*H01P 9/02* (2006.01)

(52) U.S. Cl. ..... 324/637; 324/629; 333/162; 333/5

(58) Field of Classification Search ..... 333/162, 333/163, 156, 140, 4, 5; 324/629, 632, 637
See application file for complete search history.

(56) References Cited

U.S. PATENT DOCUMENTS 2,935,705 A * 5/1960 Reis ..... 333/162
3,081,439 A * 3/1963 Bennett ..... 333/162
3,173,111 A * 3/1965 Kallmann ..... 333/162
3,277,391 A * 10/1966 Howard ..... 333/163

* cited by examiner

*Primary Examiner*—Benny Lee
(74) *Attorney, Agent, or Firm*—Kevin L. Daffer; Daffer McDaniel, LLP

(57) ABSTRACT

An improved E-field generator including a slow-wave transmission line structure is provided herein. In some cases, the improved E-field generator may include an inductively-loaded slow-wave transmission line structure driven by a power source at one end of the structure and terminated by a load at the other end of the structure. In other cases, the improved E-field generator may include a capacitively-loaded slow-wave transmission line structure. In either case, the improved E-field generator provides a frequency-independent, significantly increased electric field at a distance spaced from the generator without altering the dimensions of the generator and/or the input power supplied to the generator. The increase in generated field intensity is achieved by decreasing the phase velocity of the electromagnetic wave propagating along the parallel elements of the generator.

24 Claims, 3 Drawing Sheets

ELECTRIC FIELD GENERATOR INCORPORATING A SLOW-WAVE STRUCTURE

BACKGROUND OF THE INVENTION

1. Field of the Invention

This invention relates to electromagnetic compatibility (EMC) testing and, more particularly, to electric field generating devices, or energy transducers used for exposing devices under test to high-intensity electromagnetic fields over a large range of frequencies.

2. Description of the Related Art

The following descriptions and examples are not admitted to be prior art by virtue of their inclusion within this section.

Electromagnetic energy is considered electromagnetic interference (EMI) when it adversely affects the performance of an electronic system. All electronic devices create some form of electromagnetic energy that potentially interferes with the operation of other electrical devices outside the system (inter-system) or within the system (intra-system). As such, all electronic devices are capable of interfering with other devices (emission), or being affected by the emissions from other devices through the transfer of electromagnetic energy. The transfer of electromagnetic energy may occur as conducted energy, radiated energy, or electrostatic discharge (ESD). Conducted interference is the transfer of energy between two or more conductive paths, whereas radiated interference is the transfer of energy through space and occurs by means of near- and/or far-field coupling. Electrostatic discharge, on the other hand, is the rapid transfer of electrostatic charge between bodies of different electrostatic potential, either in proximity in air (air discharge) or through direct contact (contact discharge).

Electromagnetic energy may also produce varying levels of interference. On a low interference level, EMI may produce "cross-talk" between conductive paths, which tends to increase the background noise level within signals traversing the paths. On the other hand, however, EMI can cause significant problems and even system failure in devices that are highly sensitive to electromagnetic radiation, such as automotive electronic systems (e.g. anti-lock braking systems).

Due to the problems created by EMI, allowable limits of EMI have been set at national and international levels. For example, the Federal Communications Commission (FCC) has set limits on the amount of electromagnetic radiation that is allowably emitted from commercial electronic equipment. As such, all commercial electronic equipment must be tested for electromagnetic compatibility (EMC) and must comply with the standards set by the Commission.

Electromagnetic compatibility relates to the capability of an electronic system to operate within its intended environment at desired levels of efficiency without causing or receiving degradation due to electromagnetic interference. As such, EMC typically includes both emissions testing (i.e., how emissions originating from a system interfere with another system) and immunity testing (i.e., how a system is affected by the emissions originating from another system).

EMC testing typically involves the generation of high-intensity electromagnetic fields over a wide range of frequencies to test for the possibility of isolated, narrow band phenomena which can take place anywhere over the frequency range. Though the frequency spectrum of electromagnetic energy can span from DC (0 Hz) to gamma ray frequencies ($10^{12}$ Hz) and beyond, the frequency spectrum for use in EMC testing typically ranges from a few hertz (i.e., extreme low frequency, ELF) to approximately 40 GHz (i.e., microwave bands). This broadband generation of high-intensity electromagnetic fields typically presents a formidable challenge to designers.

In some cases, a conventional antenna may be used for electric field generation in EMC testing. However, an antenna may be subject to severe physical limitations, such as limited bandwidth, field pattern frequency dependency, and wide spatial variations in field intensity for a given frequency. In addition, antennas may require high input power to produce radiation at a distance suitable for convenient testing of a test device. Other types of electric field generators may be used to generate intense electromagnetic fields over a comparatively wider range of frequencies with relatively lower input power.

Electric field ("E-field") generators typically fall into one of two categories. The first category is the unterminated, or open-circuit E-field generator, which generates an electric field between two parallel open-ended conductors in a capacitor-like fashion. The open-circuit E-field generator normally includes two spaced, parallel elements having centers connected to opposite terminals of a signal source, which in turn is connected to a resistive load. In this manner, a device under test (DUT) may be placed between (or possibly near) the parallel conductors to measure the effect of the generated electric field on the DUT. Although the open-circuit E-field generator may produce intense electric fields in the vicinity of the parallel conductors, it may not be capable of producing sufficient field intensities over a test volume large enough to accommodate a variety of DUT sizes. For example, the open-circuit E-field generator may not produce sufficient field intensities at a distance spaced away from the generator to accommodate a large DUT without dramatically increasing the size of the generator or the input power supplied to the generator.

In addition, open-circuit E-field generators are not particularly useful in broadband applications. For example, open-circuit E-field generators are subject to resonance modes as the test frequency approaches the point in which the length (L) of the parallel elements is equal to one quarter of a wavelength (i.e., $L=\lambda/4$). In fact, due to center loading of the parallel elements, the open-circuit generator tends to resonate well before the frequency at which the length of the elements equals a quarter wavelength (e.g., 70% of $\lambda/4$). In this manner, test frequencies near resonant modes, or frequencies that are odd multiples of a quarter wavelength, may effectively short-circuit the source and disable the generator. As such, open-circuit generators are not frequency independent, and cannot produce uniform electric fields over a continuous and wide range of frequencies.

Another category of E-field generators is the transmission line generator, otherwise called an "E/H field generator" due to the fact that it generates both electric (E) and magnetic (H) fields. A transmission line generator typically includes a source at one end of a two-conductor transmission line with a terminating load arranged at an opposite end. In this manner, the terminated E-field generator is not subject to the frequency dependence or bandwidth limitations which commonly plague open-circuit generators. In addition, a terminated E-field generator may advantageously decrease the amount of power reflected within the conductors by matching the impedance of the load to the characteristic impedance of the transmission line structure. For example, if the load impedance is a matched resistive load (i.e., has a resistance substantially equal to the resistance of the conductors), the load resistor will absorb the incident wave, so that no reflected wave will be generated at the load. In this manner, a well-matched system may have a return loss (i.e., the ratio of the reflected power to the incident power) of 15 dB or more, which corresponds to a voltage standing wave ratio (VSWR) of 1.43:1 or less. Though designers strive for a relatively low VSWR value (e.g., a VSWR of 1:1 corresponds to a perfectly matched system), a device may still function adequately even when it exhibits a 3 dB return loss, or a VSWR of 5.8:1. For practical purposes, however, designers typically strive for an impedance match that provides no more than 2:1 VSwR. For critical applications, it may be desired to achieve an impedance match of less than 1.5:1.

As in the case of the open-circuit generator, a disadvantage of the terminated E-field generator is that the generated electric field cannot be increased without increasing the size of the generator and/or the input power to the generator. An inherent property of wave propagation states that the intensity of the electric field decreases as the distance from the conductive elements increases. It can be shown, however, that by using the largest possible conductive elements along with the largest possible spacing between conductive elements, the electric field can be maximized at a given distance spaced from the conductive elements. In other words, the overall dimensions of the transmission line generator must be increased to obtain greater field intensities at distances spaced from the generator. However, the required size of the generator may surpass practical limitations (such as the size of a chamber enclosing the measurement) in the pursuit of adequate field intensities for testing larger electronic devices.

Therefore, it may be desired to provide an E-field generator which is capable of producing an increased electric field at a distance spaced from the generator without increasing the dimensions of the generator or the input power supplied to the generator. In addition, the desired generator will generate an intense, localized electric field substantially independent of frequency, and thus, may operate over a continuous broadband frequency range. Thus, for a given input power and test volume, the desired E-field generator will be capable of producing a significantly greater electric field than conventional generators of comparable dimensions.

SUMMARY OF THE INVENTION

The problems outlined above may be in large part addressed by an E-field generator including a slow-wave transmission line structure. In one example, the improved E-field generator includes an inductively-loaded slow-wave transmission line structure driven by a power source at one end of the structure and terminated by a load at the other end of the structure. Alternatively, the improved E-field generator may include a capacitively-loaded slow-wave transmission line structure. In either example, the improved E-field generator provides a frequency-independent, significantly increased electric field at a distance spaced from the generator without altering the dimensions of the generator and/or the input power supplied to the generator. The increase in generated field intensity is achieved by decreasing the phase velocity of the electromagnetic wave propagating along the parallel elements of the generator. As such, the improved E-field generator is a slow-wave structure, or non-radiating device, which generates an intense, localized E-field at a given distance spaced from the generator. Because the field is predominantly localized, the improved generator is also suitable for use in shielded test chambers that are not anechoic (i.e., a chamber that tends to interact strongly and destructively with radiating devices).

In one embodiment, a field-directing element of an electric field generation system includes a slow-wave structure. Such a transmission line structure is fabricated to allow introduction of a device under test (DUT) into the vicinity of the slow-wave structure for exposure to an electric field produced by the generation system. Typically, a "slow-wave structure" may be described as any structure capable of supporting electromagnetic wave propagation with a phase velocity much smaller than the velocity of light traveling through the medium of the structure. In some cases, the slow-wave structure may be implemented as a capacitively loaded transmission line, where a capacitive element is placed in shunt between the parallel elements of the structure. However, it may be preferred to implement the slow-wave structure as an inductively loaded transmission line to avoid decreasing the test volume of the structure, in other cases. An inductively loaded transmission line would introduce inductive elements along the length of the parallel elements, as opposed to between the parallel elements of the structure.

In one example, the inductively loaded transmission line structure may include a single conductor arranged along a longitudinal axis parallel to a ground plane. However, the inductively loaded transmission line structure may preferably include a pair of conductors extending along parallel axes. In this manner, the DUT may be arranged between the single conductor and the ground plane or, alternatively, between the pair of conductors. In the case that the transmission line structure is not large enough to accommodate the DUT between the conductive elements, the DUT may be arranged at a distance spaced from the transmission line structure in a direction orthogonal to the centerline axis of the conductive elements. The centerline axis, as described herein, may be referred to as an axis arranged along a midpoint region between and parallel to the conductive elements of the transmission line structure.

In one example, the inductively loaded transmission line structure may include one or more helically shaped conductors, such that the transmission line structure is oriented along a longitudinal axis of the helix. In some cases, the helix may be arranged along and around an insulating support structure. In other cases, the transmission line structure may include a magnetic core arranged within the helix and along the longitudinal axis of the helix. The helix, however, may alternatively be fabricated such that neither an insulating support structure nor a magnetic core is included in the transmission line structure. In such a case, the helically shaped conductors may increase the length of the current path to increase the external inductance of the transmission line structure. An increase in path length typically reduces the phase velocity of the wave propagating along the conductive elements of the transmission line structure, thereby increasing the electric field generated by the transmission line structure.

In another example, the inductively loaded transmission line structure may include a conductor having a conductive surface arranged in proximity to a magnetic material structure (e.g., a structure fabricated with a magnetic material such as ferrite). In some cases, a magnetic material structure may include one or more rings encircling the conductor. In this manner, the impedance of the conductor may be increased by the proximity of the magnetic material structure to the conductive surface of the conductor. In other words, the inclusion of the magnetic material structure increases the external inductance of the conductor to ultimately increase the overall impedance of the conductor. This increase in impedance tends to reduce the phase velocity of the traveling wave to increase the electric field generated by the transmission line structure.

In yet another example, the inductively loaded transmission line structure may include a conductor having one or more conductive extensions arranged along a length of the conductor. In some cases, the conductive extensions may include conductive rings encircling the conductor. In other cases, the conductive extensions may include conductive cup-shaped structures that may completely or partially encircle the circumference of the conductor. In either case, the conductive extensions increase the length of a current path arranged along a surface of the conductor. Increasing the length of the current path tends to reduce the phase velocity of the traveling wave, thereby increasing the electric field generated by the transmission line structure.

In an alternative embodiment, an electric field generation system may include a power source and a field-directing element, such as the slow-wave structure described above. In one example, the slow-wave structure may include one or more inductively loaded transmission line structures. In this manner, the field-directing element may allow a device under test to be placed into the vicinity of the slow-wave structure for exposure to an electric field produced by the generation system. The slow-wave structure may alternatively include one or more capacitively loaded transmission line structures, however, such a case may reduce the test volume of the generation system.

In any case, the field-directing element may be generally coupled between the power source at one end of the field-directing element and a terminating load at an opposite end of the field-directing element. In this manner, the electric field generation system may be implemented such that the load is coupled to one end of the field-directing element in the vicinity near the field-directing element. In one example, the load may include a resistive load. In one example, a resistance of the resistive load may be greater than the resistance of the power source. However, if the individual resistances of the power source and the resistive load are not substantially equal to the characteristic impedance of the field-directing element, a reflected wave produced at the resistive load will interfere with an incident wave produced by the power source. Such interference typically results in the generation of a standing wave pattern, which causes significantly higher energy losses along the field-directing elements due to increased reflections within the elements. In turn, higher energy losses along the elements tend to reduce the generated electric field. Therefore, it may be preferred that the power source and resistive load are substantially matched to the field-directing elements in order to minimize reflections at the junctions between the power source/resistive load and the field-directing elements.

In some cases, the field-directing element may include a region of varying diameter to further mitigate reflections at a junction between the field-directing element and an adjacent system element. In other words, the field-directing element may include a region having a diameter that is gradually tapered from one end of the region to another end of the region. In some cases, the region of varying diameter may include an insulator of varying diameter. In other cases, the region of varying diameter may include a conductive structure, such as a conductor shaped into a helix of varying diameter. In any case, tapering of the region may gradually increase the diameter of the region from a diameter substantially equal to the diameter of an adjacent system element to a diameter substantially equal to the diameter of a central portion of the field-directing element. Alternatively, tapering of the region may gradually decrease the diameter of the region to a diameter substantially equal to the diameter of an adjacent system element from a diameter substantially equal to the diameter of a central portion of the field-directing element. In these circumstances, the adjacent system element may refer to the power source and the resistive load, respectively.

In other cases, the adjacent system element may refer to a conductive line, such as a coaxial cable. As such, the resistive load may be removed from the vicinity of the field-directing element by coupling the resistive load to the field-directing element through an additional conductive path (e.g., a coaxial cable). Removal of the resistive load from the vicinity of the field-directing element may advantageously space the heat generating components (i.e., the load) away from the field-directing element and/or the device under test.

In yet another embodiment, an electric field generation system may include a power source, a load, and an inductively loaded transmission line structure, which is coupled between the power source and the load. Such a transmission line structure may allow a device under test to be placed within the vicinity of the transmission line structure for exposure to an electric field produced by the generation system. Furthermore, a method for generating an electric field is provided herein. In one example, the method may include arranging a portion of the transmission line structure to allow introduction of a device under test into the vicinity of the portion for exposure to the generated electric field. In addition, the method may include reducing the phase velocity of a wave traveling along the portion of the transmission line structure. Such a reduction in phase velocity is generally compared to the velocity of the wave propagating within a conductor that couples the portion of the transmission line to the power supply. As stated above, the reduction in phase velocity may be achieved by inductively loading the transmission line, in one example.

BRIEF DESCRIPTION OF THE DRAWINGS

Other objects and advantages of the invention will become apparent upon reading the following detailed description and upon reference to the accompanying drawings in which.

Figure 1:
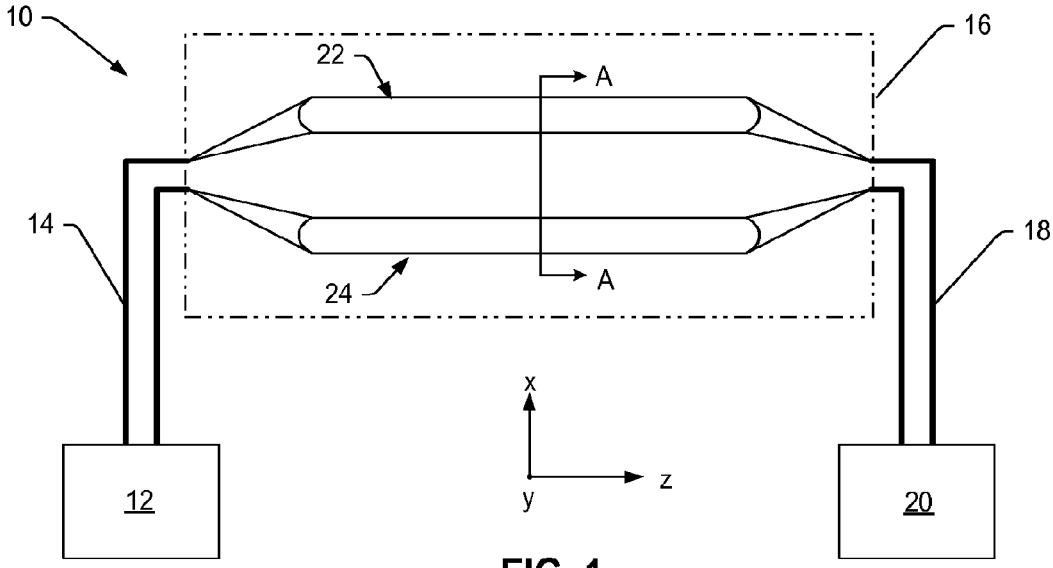
FIG. 1 is a block diagram illustrating one embodiment of a transmission line E-field generator including a pair of conductive elements driven by an RF source and terminated by a resistive load.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

Turning now to the drawings, FIG. 1 is a block diagram illustrating one embodiment of a transmission line E-field generator 10 including a pair of conductive elements (or "conductors") 22, 24 driven by a power source 12 and terminated by a balanced resistive load 20. In this manner, the transmission line generator of the present embodiment is essentially a two-conductor, balanced transmission line, which supports wave propagation in a transverse electromagnetic (TEM) mode. In TEM mode, the generated electric and magnetic fields are both transverse (i.e., x and y directions) to the direction of wave propagation along the longitudinal axis (z) of the transmission line. As such, the electric and magnetic fields along the longitudinal axis are essentially zero (i.e., $E_z=H_z=0$), while the transverse electric and magnetic fields can be expressed as quasi-static vector quantities. In other words, the field distribution over a transverse plane of a transmission line is substantially a static field distribution, such that practically no maintenance is required to sustain the generated electric and magnetic fields. This implies that almost any field level is theoretically obtainable even with limited input power.

Figure 2:
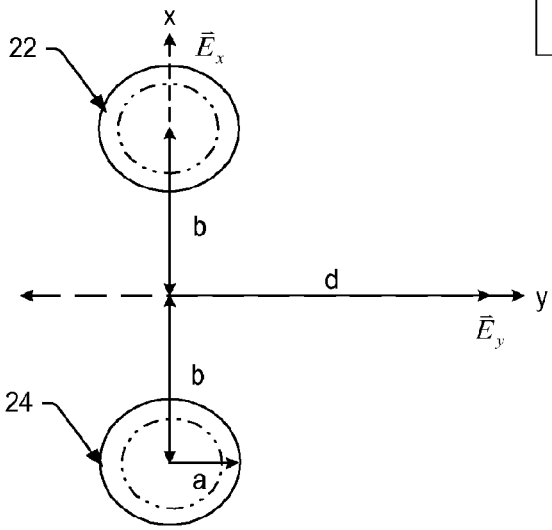
FIG. 2 is a cross-sectional view taken along plane AA of FIG. 1 showing the conductive elements as solid cylindrical structures, or alternatively, as hollow tube structures.

While many types of transmission lines can be employed as E-field generators, the two-conductor, balanced transmission line with equal size circular cylindrical conductors may be preferred in most cases. FIG. 2 shows a cross-sectional view taken along plane AA through the parallel conductors 22, 24 shown within box 16 of FIG. 1. In one example, the circular cylindrical conductors 22 and 24 are each solid conductors having radius a, and thus diameter 2*a*, and equal center-to-center spacing 2*b* between the conductors. In another example, the circular cylindrical conductors 22 and 24 may also be implemented as hollow conductive tubes (indicated by the dashed circles in FIG. 2) having dimensions similar to the previous example. In either case, the parallel conductors 22 and 24 are oriented such that electromagnetic fields are generated along axes transverse to the longitudinal axis of the two-conductor transmission line.

Due to the quasi-static behavior of the transverse electromagnetic fields, certain parameters of the transmission line, such as the characteristic impedance ($Z_o$) of the line, are substantially invariant with scaling of the transmission line dimensions (a and b). In other words, the characteristic impedance of the transmission line is proportional to the ratio of the center-to-center spacing and diameter of the conductors (i.e., b/a). Therefore, the dimensions of the E-field generator may be scaled without altering the value of the characteristic impedance.

Returning to FIG. 1, the two-conductor transmission line structure shown in box 16 is coupled between source 12 and load 20 through conductive paths 14 and 18, respectively. As such, the E-field generator of the present embodiment is a terminated, and preferably balanced, transmission line generator. In this manner, the impedances seen at the output of the source and the input of the load are substantially equal to the characteristic impedance of the transmission line structure. In one embodiment, resistance at the source 12 and load 20 are substantially equal. This impedance matching tends to reduce the amount of reflections produced by differences in impedance values between the segmental components of the generator. Thus, the two-conductor, balanced transmission line E-field generator may produce a greater electric field by reducing the amount of reflections along the line.

In one example, conductive paths 14 and 18 are ladder line structures, which also have impedance values matched to the characteristic impedance of the transmission line structure shown in box 16. As described herein, the characteristic impedance of a transmission line structure is typically about 450 Ohms so that a localized electric field may be generated at a sufficient distance spaced from the generator to accommodate a device under test (DUT) as shown in FIG. 2. However, the characteristic impedance may be higher or lower than 450 Ohms depending on the size of the DUT and the corresponding dimensions of the transmission line (a and b). In another example, conductive paths 14 and 18 may each be constructed to minimize the reflections between source 12 and conductors 22, 24 and/or between conductors 22, 24 and load 20, respectively. To further minimize reflections between conductive paths 14 and 18 and conductors 22, 24, the transitions from conductive paths 14 and 18 to/from the parallel segments of conductors 22, 24 may be implemented as tapered transitions. In other words, the b/a ratio at the end segments of conductors 22, 24 may be gradually scaled to maintain constant characteristic impedance between the conductive paths and the parallel segments of conductors 22, 24. In practice, this gradual scaling produces very little reflections along the transmission line.

The generation of electromagnetic fields by a transmission line E-field generator of the present embodiment may be easily described in mathematical terms, such as those represented by the exemplary equations presented below. Thus, in reference to FIGS. 1 and 2, the transmission line structure shown in box 16 is oriented along a longitudinal (z) axis with parallel conductors centered at x=±b. In this manner, the electric fields (E) generated in the transverse planes (x and y) of the structure can be expressed as:

$$E_x = -\frac{\rho_l}{2\pi\varepsilon}\left[\frac{x+\left(\frac{d}{2}\right)}{\left[x+\left(\frac{d}{2}\right)\right]^2+y^2} - \frac{x-\left(\frac{d}{2}\right)}{\left[x-\left(\frac{d}{2}\right)\right]^2+y^2}\right] \quad \text{(EQ. 1)}$$

$$E_y = -\frac{\rho_l y}{2\pi\varepsilon}\left[\frac{1}{\left[x+\left(\frac{d}{2}\right)\right]^2+y^2} - \frac{1}{\left[x-\left(\frac{d}{2}\right)\right]^2+y^2}\right] \quad \text{(EQ. 2)}$$

where $\rho_l$ is the charge per unit length on the transmission line, $\epsilon$ is the permittivity of the conductive material of the line, and d is the distance at which the generated electric field is localized in the transverse plane (x=0), as shown in FIG. 2. For circular, cylindrical conductors the distance d can be expressed as:

$$d = \frac{1}{2}\left(2b + \sqrt{(2b)^2 - (2a)^2}\right) \quad \text{(EQ. 3)}$$

where a is the radius of the cylindrical conductors and 2b is the center-to-center spacing between the conductors. In addition, the charge per unit length ($\rho_l$) of the transmission line conductors can be related to the current I flowing on the conductors (assuming one-dimensional continuity and time harmonic excitation) as:

$$\rho_l = \frac{I}{c_{phase}} \quad \text{(EQ. 4)}$$

where $c_{phase}$ is the phase velocity of the electromagnetic wave propagating along the length of the conductors. In addition, since the current on the conductors can also be related to the forward power ($P_{forward}$) through a fundamental definition of power (i.e., $P=I^2Z$), the charge per unit length can further be related to the forward power as:

$$\rho_l = \frac{\sqrt{\frac{P_{forward}}{Z_o}}}{c_{phase}} \quad \text{(EQ. 5)}$$

In this manner, the above expression for charge per unit length (as shown in EQ. 5) can be substituted into the expressions for the transverse electric fields (as shown in EQS. 1 and 2), such that $$E_x = -\frac{\sqrt{\frac{P_{forward}}{Z_o}}}{2\pi\varepsilon * c_{phase}}\left[\frac{x+\left(\frac{d}{2}\right)}{\left[x+\left(\frac{d}{2}\right)\right]^2 + y^2} - \frac{x-\left(\frac{d}{2}\right)}{\left[x-\left(\frac{d}{2}\right)\right]^2 + y^2}\right] \quad \text{(EQ. 6)}$$

$$E_y = -\frac{\sqrt{\frac{P_{forward}}{Z_o}}}{2\pi\varepsilon * c_{phase}}\, y\left[\frac{1}{\left[x+\left(\frac{d}{2}\right)\right]^2 + y^2} - \frac{1}{\left[x-\left(\frac{d}{2}\right)\right]^2 + y^2}\right] \quad \text{(EQ. 7)}$$

EQS. 6 and 7 indicate that the transverse electric fields ($E_x$ and $E_y$) are directly proportional to the forward power ($P_{forward}$) and inversely proportional to the characteristic impedance of the transmission line structure $Z_o$. Thus, the above relationships show that by increasing the characteristic impedance of the transmission line structure, the charge per unit length on the transmission line is reduced, thereby resulting in a decreased electric field. Such an observation, however, may be counter-intuitive to a skilled artisan since increasing the characteristic impedance of the line should increase the voltage across the line (e.g., Ohm's Law, V=I*Z). In fact, increasing the characteristic impedance (with all other parameters held constant) typically involves decreasing the diameter of the conductors. However, though decreasing the diameter of the conductors increases the field intensity in the vicinity of the conductors, it does not increase the field intensity at a distance d spaced from the conductors. Therefore, an electric field intensity generated at a distance d (to accommodate a device under test (DUT), as shown in FIG. 2) cannot be increased by merely increasing the characteristic impedance of the transmission line structure. In addition, it is usually desired that the amount of power required to operate an electrical device be minimized so as to reduce the operational costs of the device. Therefore, it would also be undesirable to increase the forward power to obtain higher-intensity electric fields.

Instead of increasing the characteristic impedance of the transmission line structure, it may be desirable to provide an alternative means to generate an increased electric field at a distance spaced from the transmission line structure. In a two-conductor transmission line generator, for example, the field intensities are maximum in the transverse planes, x=0 and y=0, and can be expressed as:

$$E_x|_{x=0} = |E_o|\frac{d}{4}\left[\frac{\left(\frac{d}{2}\right)}{\left[x+\left(\frac{d}{2}\right)\right]^2 + y^2} - \frac{-\left(\frac{d}{2}\right)}{\left[x-\left(\frac{d}{2}\right)\right]^2 + y^2}\right] = E_o\left[\frac{\left(\frac{d}{2}\right)^2}{\left(\frac{d}{2}\right)^2 + y^2}\right] \quad \text{(EQ. 8)}$$

$$E_y|_{y=0}=0 \quad \text{(EQ. 9)}$$

where $|E_o|$ is the magnitude of the generated electric field. For the present embodiment, the magnitude of the generated electric field can be approximated by:

$$|E_o| = C_1\frac{\sqrt{\frac{P_{forward}}{Z_o}}}{d} \quad \text{(EQ. 10)}$$

where $C_1$ is a constant. In this manner, the above equations show that the electric field intensity along the y-axis (in the x=0 plane) decreases with increasing distance from the center of the transmission line. For example, the field intensity will decay by a factor of 2 at a distance of y=d/2 from the center of the transmission line. In practice, a typical transmission line generator may produce an electric field intensity of 100 V/m RMS at a distance of 1 meter in front of the device with 2500 Watts of input power. However, it may be much more desirable to produce 200 V/m at the same distance and input power, since 200 V/m is a standard level for immunity testing.

One way to achieve such an objective is to scale the dimensions of the transmission line structure. For example, if the distance between the cylindrical conductors is much larger than the diameter of the conductors (e.g., b>>a) then EQ. 3 can be simplified to d≈2b, such that the distance d is approximately equal to the center-to-center spacing between conductors. In this manner, the expressions for $E_o$ and $E_x$ become independent of the conductor diameter (except for the implicit dependence in $Z_o$), such that:

$$|E_o| = C_2\frac{\sqrt{\frac{P_{forward}}{Z_o}}}{b}, \quad \text{(EQ. 11)}$$

where $C_2$ is another constant, and

-continued $$E_x|_{x=0} = |E_o|\left[\frac{b^2}{b^2+y^2}\right]. \quad \text{(EQ. 12)}$$

Now, the electric field at a point $y=y_0$ can be maximized by differentiating $E_{x0}$ with respect to y, such that:

$$\frac{dE_{x0}}{dy} = C_1\sqrt{\frac{P_{forward}}{Z_o}}\left[\frac{y^2-b^2}{y^2+b^2}\right]. \quad \text{(EQ. 13)}$$

By setting EQ. 13 equal to zero, a maximum value of the transverse electric field in the x=0 plane is found when $y=y_0=b$. In other words, when the characteristic impedance and forward power are held constant, the transverse electric field can be increased at a distance, $y_0$, by increasing the spacing between conductors. Thus, the field intensity at a particular point in the x=0 plane is maximized by using the largest possible conductors, for the reasons described above, with the largest possible center-to-center spacing. In other words, simply increasing the overall size of the generator is one way to obtain greater fields. However, the geometry of the generator may be limited by practical considerations, such as limited space for testing equipment. As such, practical considerations may not allow the generator geometry to be scaled large enough to accommodate larger test devices.

Preferred embodiments of a two-conductor, balanced, transmission line E-field generator are described in reference to FIGS. 3-9. In such embodiments, the transverse electric field can be increased by focusing on energy considerations instead of geometrical or input parameters. In particular, the transverse electric field may be increased by increasing the electric energy stored per unit length along the transmission line conductors. The electric energy stored per unit length ($W_E$) along a transmission line may be expressed in terms of the distributed capacitance (C) of the line and the magnitude of the voltage (V) across the line (which is constant for progressive wave motion):

$$W_E = \frac{1}{2}C|V|^2 \quad \text{(EQ. 14)}$$

Likewise, the magnetic energy stored per unit length ($W_M$) along a transmission line may be expressed in terms of the distributed inductance (L) of the line and the magnitude of the current (I) on the line (which is constant for progressive wave motion):

$$W_M = \frac{1}{2}L|I|^2 \quad \text{(EQ. 15)}$$

Furthermore, it can be shown that equipartition of energy is maintained for progressive wave motion. Since both the characteristic impedance ($Z_o$) of the line and the phase velocity ($c_{phase}$) of the electromagnetic wave propagating along the line can be expressed purely in terms of inductance and capacitance, the stored energy per unit length can be expressed as:

$$W_E = W_M = \frac{1}{2}\frac{P}{c_{phase}} \quad \text{(EQ. 16)}$$

EQ. 16 illustrates that the stored electric energy ($W_E$) and/or magnetic energy ($W_M$) per unit length along the line depends only on the power (P) and the phase velocity ($c_{phase}$) of the traveling electromagnetic wave. In fact, the energy stored per unit length is independent of the characteristic impedance ($Z_o$) of the line. For example, in the case of constant power, the characteristic impedance of the line can be increased to increase the voltage across the line; however, the stored electric energy per unit length will remain unchanged. As stated above, equipartition of energy is always satisfied for progressive wave motion. Therefore, to increase the electric energy stored per unit length, it is necessary to also increase the magnetic energy. Thus, a preferred method for increasing the stored magnetic and electric energy per unit length (without increasing the power) is to reduce the phase velocity of the electromagnetic wave. As stated above, the characteristic impedance and phase velocity can be expressed purely in terms of inductance (L) and capacitance (C) as:

$$c_{phase} = \sqrt{\frac{1}{(L_{int}+L_{ext})C}}, \text{ and} \quad \text{(EQ. 17)}$$

$$Z_o = \sqrt{\frac{(L_{int}+L_{ext})}{C}} \quad \text{(EQ. 18)}$$

where $L_{int}$ and $L_{ext}$ denote the internal and external inductance of the conductive elements, respectively.

Figure 3A:
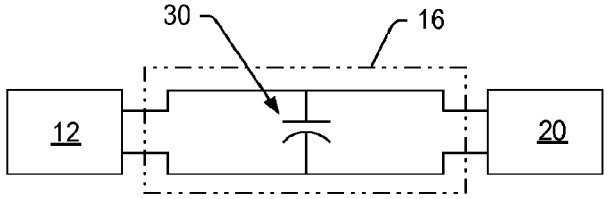
FIGS. 3A and 3B are simplified circuit diagrams illustrating alternative embodiments of the conductive elements shown in FIG. 1 as being either capacitively loaded or inductively loaded, respectfully.
Figure 3B:
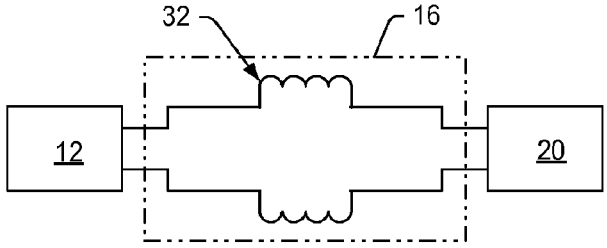

FIGS. 3A and 3B can be combined with EQS. 17 and 18 to illustrate alternative means for reducing the phase velocity of the electromagnetic wave propagating along the transmission line structure between source 12 and load 20. As used herein, such means may be referred to as a slow-wave structure, since loading of the structure results in a reduced (i.e., slower) phase velocity. FIG. 3A, for example, is a simplified circuit diagram of the E-field generator 10 shown in FIG. 1 and described above, illustrating one embodiment by which the phase velocity can be reduced by increasing the capacitive loading of the transmission line. Capacitive loading, however, may require that capacitive element 30 be placed in shunt between the parallel elements of the slow-wave structure, as shown schematically in box 16 of FIG. 3A. In such a case, capacitive element 30 may disadvantageously reduce the test volume of the generation system by placing capacitive element 30 between the parallel elements.

Therefore, another embodiment for reducing the phase velocity is presented in FIG. 3B. FIG. 3B is a simplified circuit diagram of the E-field generator 10 shown in FIG. 1 and described above. FIG. 3B illustrates inductive loading of the slow-wave structure shown schematically in box 16. In such an embodiment, the external inductance ($L_{ext}$) may be increased by loading the slow-wave structure with inductive elements 32 along the length of the slow-wave structure. As can be seen in reference to EQ. 17, increasing the external inductance of the transmission line not only decreases the phase velocity of the traveling wave, but also allows test devices to be placed between the parallel elements of the transmission line (see FIG. 3B). In this manner, inductive loading of the transmission line would allow test devices to be placed between the parallel elements of the line, thereby maintaining the test volume of the generation system.

Figure 4:
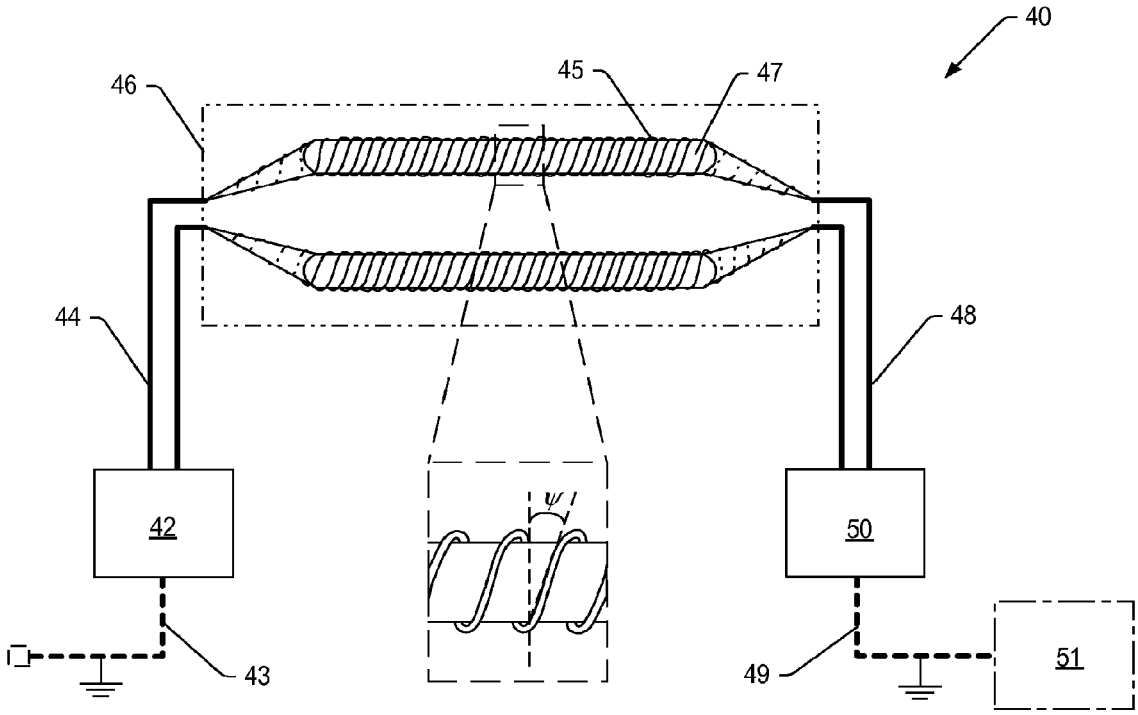
FIG. 4 is a block diagram illustrating embodiments of a transmission line E-field generator including a pair of inductively loaded, helix-shaped conductors driven by an RF source and terminated by a resistive load in the vicinity near the generator, or alternatively, terminated by a resistive load at a distance spaced from the generator.

FIG. 4 is a block diagram illustrating preferred embodiments of a transmission line E-field generator 40 including an inductively loaded slow-wave structure 46, which is driven by a source 42 and terminated by a resistive load 50 in the vicinity near the generator. Slow-wave structure 46 includes inductively loaded conductors 45 and core elements 47. In one embodiment shown in FIG. 4, conductors 45 are implemented as conductive wires, which are helically-wound around the parallel segments of core elements 47. However, the helical conductors 45 may further be wound around the transitional segments of core elements 47, as shown by dashed lines in FIG. 4. In one example, core elements 47 are insulative structures having a shape similar to the shape of conductors 16 in FIG. 1. As such, core elements 47 may be fabricated using a type of plastic, such as polyethylene, or any other insulating material. However, core elements 47 may also be magnetic structures, or alternatively, it may not even be necessary to include core elements 47. For example, helical conductors 45 may be constructed in such a manner that core elements 47 are not needed to support conductors 45.

In any case, helical conductors 45 increase the external inductance of slow-wave structure 46 by increasing the length of the current path, thereby reducing the phase velocity of the electromagnetic wave propagating along the longitudinal axis of the conductors. Therefore, a slower phase velocity, and hence a greater field intensity, can be obtained by winding the helical conductors on the largest diameter core element that is mechanically and/or electrically acceptable. In other words, it may be preferred that the diameter of the helices be as large as possible, such that the helical conductors 45 are wound with the highest characteristic impedance that can be matched with a resistive load. Alternatively, it may be preferred that the helical conductors 45 be fabricated using an adhesive material, such as copper adhesive tape, to minimize the weight and mechanical constraints placed on the helical conductors. In another example, the tape helix can also be fabricated using electroplated plastic cylinders.

FIG. 4 further illustrates that the inductively loaded slow-wave structure 46 is coupled between source 42 and resistive load 50 via conductive paths 44 and 48, respectively. In one example, conductive paths 44 and 48 are ladder line structures, for the same reasons set forth above in reference to FIG. 1. In another example, conductive paths 44 and 48 may be any other conductive means, which minimize the reflections between source 42 and slow-wave structure 46, and between slow-wave structure 46 and load 50, respectively.

In an alternative embodiment, however, slow-wave structure 46 may be terminated by resistive load 50 such that a portion of resistive load 50 (designated as numeral 51) may be spaced from generator 40. In such an embodiment, the portion 51 may be coupled to load 50 via an additional conductive path 49. However, it may be necessary to space all of load 50 from generator 40. In one example, conductive path 49 is a coaxial cable coupled between a coaxial load output of load 50 and portion 51. The shield of coaxial cable 49 may also be coupled to ground to minimize reflections along the cable. Grounding the shield of coaxial cable 49 also reduces interference that may be generated by the cable. As such, interference that did not originate from the device under test (DUT) is avoided, so that it does not influence the measurements taken from the DUT. In addition, the heat generating elements (i.e., portion 51) within load 50 can be removed from the immediate vicinity of generator 40 to avoid additional interference with the generator and/or the device under test.

A prototypical example of a transmission line generator of FIG. 4 may include a conductor diameter of a=2.25 inches and a center-to-center spacing between conductors of b=32 inches. These exemplary dimensions would provide a characteristic impedance for a uniform, unloaded line of approximately 400 Ohms. The above equations, however, show that a larger electric field is obtainable with a larger characteristic impedance and/or slower phase velocity. It is noted that the phase velocity for a helical conductor can be further expressed as:

$$c_{phase}=c(\sin\psi) \qquad \text{(EQ. 19)}$$

where $\psi$ is the pitch angle (see insert of FIG. 4) and c is the velocity at which the electromagnetic wave propagates along the helical conductor (and hence progresses along the longitudinal direction (z) with a phase velocity, $c_{phase}$). In one example, a pitch angle between the helical windings of about 45° will slow the propagating wave by a factor of $1/\sqrt{2}$, thereby increasing the characteristic impedance to approximately 800 Ohms. Though practical limitations in broadband RF transformers tend to limit the impedance level to less than about 1000 Ohms, transformers with moderate bandwidth (e.g., one octave) may be implemented for transforming to higher levels of impedance.

Another advantage of the helix-shaped conductors is the essential lack of frequency dispersion in the fully developed region (i.e. parallel segments of conductors 45). In other words, the group velocity (i.e., the velocity with which a signal consisting of a very narrow band of propagating frequency components) is substantially equal to the phase velocity when there is substantially no frequency dispersion. In this manner, practically all frequency components within the signal propagate at the same velocity ($c_{phase}$), such that almost no signal distortion occurs. Also, the longitudinal field ($E_z$) and the azimuthal field ($E_x$) should cancel along the centerline to result in a considerably undistorted, maximum electric field ($E_y$) at a distance spaced from the conductors.

Figure 5:
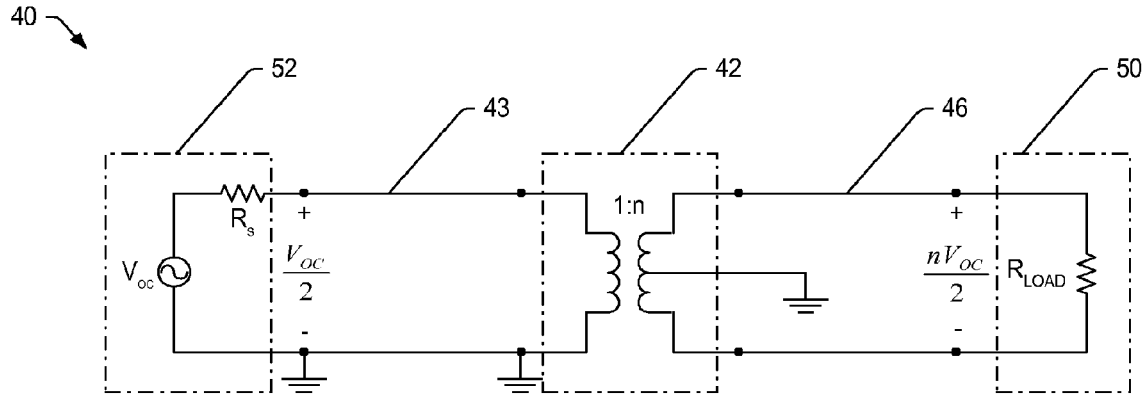
FIG. 5 is a simplified circuit diagram illustrating an embodiment of the E-field generator shown in FIG. 4.

FIG. 5 is a simplified circuit diagram describing one embodiment of the E-field generator 40 shown in FIG. 4 and described above. Block 52, which is not shown in FIG. 4, illustrates one example of an equivalent circuit for the output stage of a power amplifier. The power amplifier shown schematically in block 52 provides power, via the coaxial cable 43 shown in FIGS. 4-5, for driving the transformer and balancing network 42 (otherwise denoted as source 42 in FIG. 4). As such, the power amplifier may include at least a source voltage, $V_{oc}$, and an output resistance, $R_s$. Typically, the output stage of the power amplifier has an output resistance of 50 Ohms. If the output resistance of the power amplifier is substantially matched to the characteristic impedance of coaxial cable 43 (such that, $R_s=Z_c=50$ Ohms), the maximum driving power ($P_{max}$) at the output stage of the power amplifier will be:

$$P_{max}=\left(\frac{V_{oc}}{2}\right)\left(\frac{1}{R_s}\right) \qquad \text{(EQ. 20)}$$

Otherwise, the driving power may be less when cable 43 is not sufficiently matched with the output stage of the power amplifier.

The driving power from the amplifier (block 52, FIG. 5) is coupled to transforming and balancing network 42 via cable 43. In one example, network 42 includes a single 1:n broadband transformer, which provides radio frequency (RF)

power from the power amplifier to slow-wave structure 46 over a wide range of frequencies corresponding to a desired test range of one or more devices under test. The 1:n broadband transformer increases the voltage seen at its input (and hence, the input impedance) by a factor of n, where n typically equals $\sqrt{Z_o/R_s}$. For example, if the characteristic impedance of slow-wave structure 46 is $Z_o$=450 Ohms, then broadband transformer will be a 1:9 step-up transformer, and will desirably increase the 50 Ohm input impedance at the powers source to a 450 Ohm output impedance at the resistive load.

In some cases, a broadband transformer may suffer from bandwidth limitations. Therefore, it may be preferred that network 42 include multiple transformers, in another example. In this manner, each of the multi-stage transformers may provide RF power to slow-wave structure 46 over individual frequency ranges corresponding to subsets within a desired test frequency range of one or more devices under test. The combined output of such multi-stage transformers will result in a 1:n increase in both voltage and impedance. For example, network 42 may include a 50:200 Ohm equal-delay transformer and balancing network combined with a 200:450 Ohm balanced bootstrap transformer to result in a 50:450 Ohm transforming and balancing network. In some cases, network 42 may include more than two transformers to match the input impedance to the characteristic impedance of slow-wave structure 46.

In some cases, it may be desired to include a balancing network, otherwise known as a stabilization network, no matter how many stages are used to implement the transforming stages within network 42. A balancing network advantageously ensures that a constant impedance level will be presented over the desired frequency range. A balancing network is further beneficial in that it blocks the conducted emissions that do not originate from the DUT so that only the emissions from the DUT will be measured.

The output of network 42 may then be coupled to slow-wave structure 46, where the phase velocity ($c_{phase}$) of the traveling electromagnetic wave is reduced by one of several methods (see FIGS. 4, 6-9). As stated above, a reduction in phase velocity advantageously increases the electric field generated at a distance spaced from the generation system. In addition, the output of slow-wave structure 46 is preferably terminated with a resistive load ($R_{LOAD}$) 50, as indicated in FIGS. 4 and 5. With broadband impedance transformer 42, the voltage seen across load 50 can be $nV_{OC}/2$. In this manner, resistive load 50 may absorb the input power ($P_{max}$) from the power amplifier (block 52, FIG. 5) if resistive load 50 is sufficiently matched with the characteristic impedance of slow-wave structure 46. In such a case, a reflected wave will most likely not be produced at load 50 to interfere with the incident traveling wave. Therefore, FIG. 5 represents a well-balanced system capable of producing a high-intensity electric field localized at a distance spaced from the generation system.

Figure 6:
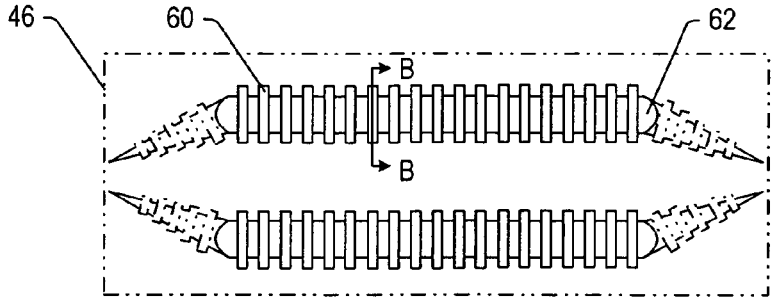
FIG. 6 is a block diagram illustrating alternative embodiments for inductively loading the transmission line E-field generator of FIG. 4 with magnetic or electrically conductive ring structures.
Figure 7:
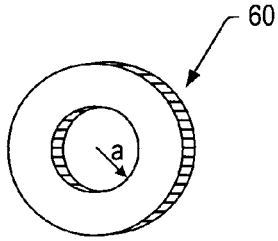
FIG. 7 is a three-dimensional cross-sectional view taken along plane BB of FIG. 6 to illustrate the shape of the magnetic and electrically conductive ring structures, according to one example.
Figure 8:
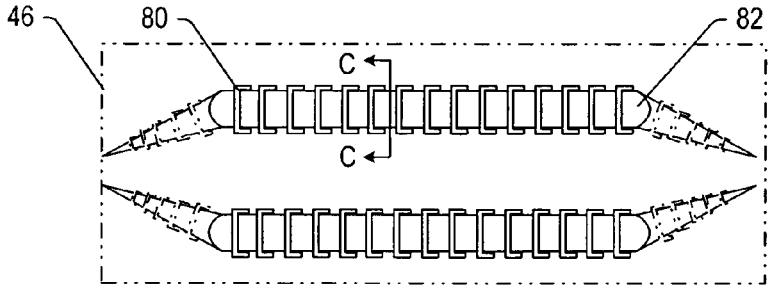
FIG. 8 is a block diagram illustrating yet another alternative embodiment for inductively loading the transmission line E-field generator of FIG. 4 with electrically conductive cups.

FIG. 6 illustrates an alternative embodiment of the inductively loaded slow-wave structure 46. In one example, slow-wave structure 46 may include one or more magnetic material structures 60 arranged in proximity to a pair of core elements 62. In one example, the one or more magnetic material structures 60 may be fabricated using a magnetic material such as ferrite, but can also be fabricated using any other acceptable magnetic material. In the embodiment of FIG. 6, magnetic material structures 60 are illustrated as encircling the parallel segments of core elements 62. However, magnetic material structures 60 may also encircle the transitional segments of core elements 62, as shown by dashed lines in FIG. 6. In addition, FIG. 7 shows an exemplary configuration of magnetic material structures 60, in which the structures have interior diameters that are substantially equal to the outer diameter of core elements 62. Preferably, magnetic material structures 60 are comprised of substantially circular rings, in order to avoid charge accumulation that may otherwise occur at sharp edges.

In one example, core elements 62 are preferably fabricated as conductive structures. In this manner, adding one or more magnetic material structures 60 (i.e., inductive material) around (i.e. in the proximity of) the conductive outer surface of core elements 62 will result in an increased external inductance ($L_{ext}$) associated with core elements 62. Subsequently, the increased external inductance will result in an increased characteristic impedance and decreased phase velocity of the traveling wave along core elements 62. As stated above, such a reduction in phase velocity will increase the generated electric field at a distance spaced from the generator.

Further preferred embodiments of the inductively loaded slow-wave structure 46 are shown in FIGS. 6-9. For example, FIG. 6 may be alternatively described as including conductive core elements 62 having one or more conductive extensions 60 arranged along its length. In one example, conductive extensions 60 may be electrically conductive rings (see FIG. 7), such that one or more electrically conductive rings 60 encircle the parallel segments of conductive core elements 62. Similar to previous embodiments, the electrically conductive rings may also be arranged along the transitional segments of core elements 62, as indicated by the dashed lines in FIG. 6. Adding one or more electrically conductive rings 60 to core elements 62 increases the path in which current must flow along the surface of the conductor. The increase in path length reduces the phase velocity to ultimately increase the generated electric field intensity at a distance spaced from the generator.

Moreover, the conductive extensions may be alternatively shaped as indicated in FIGS. 8 and 9A-9C. For example, conductive extensions 80 may be electrically conductive cup-shaped structures, which are arranged along the length of conductive core elements 82. Again, conductive extensions 80 may be arranged along the parallel segments of conductive core elements 82, and in some cases, may also be arranged along the transitional segments of elements 82 (as indicated by the dashed lines in FIG. 8).

Figure 9A:
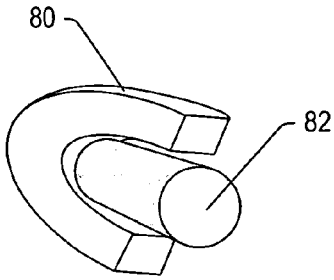
FIGS. 9A, 9B, and 9C are three-dimensional cross-sectional views taken along plane CC of FIG. 8 to illustrate exemplary embodiments of the electrically conductive cup structures.
Figure 9B:
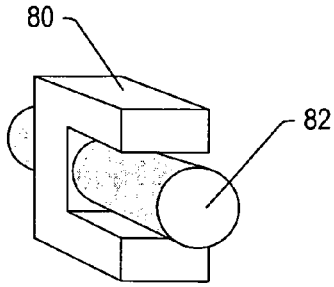
Figure 9C:
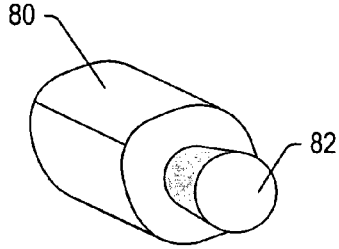

Exemplary embodiments of cup-shaped structures 80 are illustrated in FIGS. 9A-9C. It is noted, however, that cup-shaped structures 80 are not limited to only the examples provided herein. In the examples shown, cup-shaped structures 80 are depicted as u-shaped conductors in FIG. 9A, and alternatively, as c-shaped conductors in FIG. 9B. However, cup-shaped structures 80 may preferably be shaped as depicted in FIG. 9C. In such an example, structures 80 have substantially no sharp corners (to reduce charge build-up) and are specifically configured to encircle the circumference of core elements 82. In any case, adding one or more cup-shaped structures 80 to core elements 62 increases the path in which current must flow along the surface of the conductor. Similar to the electrically conductive rings described above, the increase in path length reduces the phase velocity to increase the field intensity at a distance spaced from the generator.

It will be appreciated to those skilled in the art having the benefit of this disclosure that this invention is believed to provide an improved E-field generator, which generates a greater electric field for a given amount of input power than conventional transmission line E-field generators of comparable dimensions. The improved E-field generator overcomes the limitations of the conventional transmission line E-field generator by storing more energy per unit length along the transmission line. Such an increase in stored energy per unit length is achieved by decreasing the phase velocity of the electromagnetic wave propagating along the longitudinal axis of the transmission line. Further modifications and alternative embodiments of various aspects of the invention will be apparent to those skilled in the art in view of this description. It is intended that the following claims be interpreted to embrace all such modifications and changes and, accordingly, the specification and drawings are to be regarded in an illustrative rather than a restrictive sense.

The invention claimed is:

1. A method for generating an electric field, said method comprising:

arranging a device under test (DUT) within a vicinity of a portion of a transmission line for exposure of the DUT to the generated electric field, wherein the vicinity comprises a distance spaced from the transmission line in a direction orthogonal to a longitudinal axis of the transmission line; and reducing a phase velocity of a wave traveling into and along the portion of transmission line, as compared to the wave's velocity in a conductor coupling the portion of transmission line to a power supply.

2. The method recited in claim 1, wherein said reducing the phase velocity comprises inductively loading the transmission line.

3. A field-directing element for an electric field generation system, said field-directing element comprising a slow-wave transmission line structure, wherein said generation system produces an electric field for exposing a device under test (DUT) arranged within the vicinity of the slow-wave transmission line structure, and wherein said slow-wave transmission line structure localizes the generated electric field a spaced distance away from the transmission line structure in a direction orthogonal to a longitudinal axis of the transmission line structure.

4. The field-directing element recited in claim 3, wherein the slow-wave transmission line structure comprises a capacitively-loaded transmission line.

5. The field-directing element recited in claim 3, wherein the slow-wave transmission line structure comprises an inductively-loaded transmission line.

6. The field-directing element recited in claim 5, wherein the inductively-loaded transmission line comprises a pair of conductors extending along parallel directions.

7. The field-directing element recited in claim 5, wherein the inductively-loaded transmission line comprises a conductor shaped into a helix, and wherein the inductively loaded transmission line is oriented along a longitudinal axis of the helix.

8. The field-directing element recited in claim 7, wherein the helix is arranged around an insulating support structure.

9. The field-directing element recited in claim 7, wherein the inductively-loaded transmission line further comprises a magnetic core arranged within the helix and along the longitudinal axis of the helix.

10. The field-directing element recited in claim 5, wherein the inductively-loaded transmission line comprises a conductor having a conductive surface arranged in proximity to a magnetic material structure, and wherein an impedance of the conductor is increased by the proximity of the magnetic material structure.

11. The field-directing element recited in claim 10, wherein the magnetic material structure comprises ferrite.

12. The field-directing element recited in claim 10, wherein the magnetic material structure comprises one or more rings encircling the conductor.

13. The field-directing element recited in claim 5, wherein the inductively-loaded transmission line comprises a conductor having one or more conductive extensions arranged along a length of the conductor, and wherein the one or more conductive extensions lengthen a current path along the surface of the conductor.

14. The field-directing element recited in claim 13, wherein the one or more conductive extensions comprise conductive rings encircling the conductor.

15. An electric field generation system comprising:

a power source;

a field-directing element coupled to the power source, wherein the field-directing element comprises a slow-wave structure for localizing an electric field generated by the generation system at a location spaced from the slow-wave structure, wherein said localization enables a device under test (DUT) to be placed within a vicinity of the slow-wave structure for exposure of the device to the electric field produced by the generation system.

16. The system recited in claim 15, wherein the slow-wave structure comprises an inductively-loaded transmission line.

17. The system recited in claim 15, further comprising a load coupled to the slow-wave structure, wherein the slow-wave structure is coupled between the power source and the load.

18. The system recited in claim 17, wherein the load comprises a resistive load.

19. The system recited in claim 18, wherein a resistance of the resistive load is substantially equal to a resistance of the power source.

20. The system recited in claim 18, wherein a resistance of the resistive load is greater than a resistance of the power source.

21. The system recited in claim 15, wherein the field-directing element comprises a region of varying diameter adapted to mitigate reflections at a junction between the field-directing element and an adjacent system element.

22. The system recited in claim 21, wherein the adjacent system element comprises the power source, a load or a coaxial line.

23. The system recited in claim 21, wherein the region of varying diameter comprises an insulator of varying diameter.

24. The system recited in claim 21, wherein the region of varying diameter comprises a conductor shaped into a helix of varying diameter.

* * * * *